US008141378B2

(12) United States Patent
Hayase

(10) Patent No.: US 8,141,378 B2
(45) Date of Patent: Mar. 27, 2012

(54) TOP PLATE AND MECHANICAL ROOM OF A REFRIGERATED SHOWCASE

(75) Inventor: Koji Hayase, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 861 days.

(21) Appl. No.: 12/196,570

(22) Filed: Aug. 22, 2008

(65) Prior Publication Data

US 2009/0084124 A1 Apr. 2, 2009

(30) Foreign Application Priority Data

Sep. 27, 2007 (JP) ..... 2007-251241

(51) Int. Cl.
*A47F 3/04* (2006.01)
*F25D 19/00* (2006.01)

(52) U.S. Cl. ..... 62/246; 62/248; 62/297; 62/298

(58) Field of Classification Search ..... 62/246, 62/248, 297, 298
See application file for complete search history.

(56) References Cited

U.S. PATENT DOCUMENTS 3,462,966 A 8/1969 Reid et al. ..... 62/248

FOREIGN PATENT DOCUMENTS

| | | | |
|---|---|---|---|
| AU | 757025 | | 1/2003 |
| CA | 1316359 | | 4/1993 |
| EP | 1371922 | | 12/2003 |
| EP | 1535542 | | 6/2005 |
| FR | 2855871 | | 12/2004 |
| GB | 2227302 | | 7/1990 |
| JP | 60-138186 | | 9/1985 |
| JP | 02-143075 | * | 6/1990 |
| JP | 5-52682 | | 7/1993 |
| JP | 05-203332 | | 8/1993 |
| JP | 5-203332 | | 8/1993 |
| JP | 200-258032 | | 9/2000 |
| JP | 2004-294031 | | 10/2001 |
| JP | 2003-176972 | | 6/2003 |
| JP | 2005-09779 | * | 1/2005 |

OTHER PUBLICATIONS

European Search Report dated Jan 23, 2009.

* cited by examiner

*Primary Examiner* — Frantz Jules
*Assistant Examiner* — Cassey D Bauer
(74) *Attorney, Agent, or Firm* — Kratz, Quintos & Hanson, LLP

(57) ABSTRACT

An object of the present invention is to provide a showcase wherein an insulating wall and a top plate of a machine room covering a lower surface of the insulating wall can be stably held and the strength of the entire showcase can be improved. In the showcase, a display room is provided over the insulating wall; a machine room is provided under the insulating wall; a compressor, a condenser and the like of a cooling unit are disposed in the machine room; a cooling room is provided in the insulating wall; and an evaporator and a cooling fan of the cooling unit are disposed in the cooling room so that cold air heat-exchanged with the evaporator is circulated in the display room by the cooling fan, and the showcase further comprises a top plate of the machine room to cover the lower surface of the insulating wall, and the top plate is mounted on and fixed to a pipe plate of the condenser to hold the insulating wall.

1 Claim, 9 Drawing Sheets

TOP PLATE AND MECHANICAL ROOM OF A REFRIGERATED SHOWCASE

BACKGROUND OF THE INVENTION

The present invention relates to a showcase in which a display room is provided over an insulating wall; a machine room containing a compressor and the like is provided under the insulating wall; a cooling room is provided in the insulating wall; and an evaporator and a cooling fan of a cooling unit are installed in the cooling room so that cold air heat-exchanged with the evaporator is circulated in the display room by the cooling fan.

In a conventional showcase of this kind, left, right, and rear transparent walls and a front transparent door (transparent wall) are attached to supporting columns standing at four corners of an insulating wall so that a display room surrounded by the transparent walls is provided over the insulating wall. In the insulating wall, a cooling room is provided in which an evaporator and a cooling fan of a cooling unit are disposed. Under the insulating wall, there is provided a machine room in which a compressor, a condenser and the like disposed. By operating the compressor and the like, the evaporator exerts a cooling function and the cooling fan serves to eject cold air from one side of the insulating wall and suck the cold air from the other side of the insulating wall. The cold air is thereby circulated into the display room to cool the interior of the display room to a predetermined temperature (e.g., see Japanese Patent Unexamined Publication No. hei 5-203332).

In such a showcase, angles are attached to four corners of a base that serves as the bottom of the machine room, and the angles hold the insulating wall. Supporting columns which vertically extend in the showcase are attached to four corners of the insulating wall. Thus, the machine room having a predetermined height is provided under the insulating wall. Over the insulating wall, there is provided the display room defined by the transparent walls attached to the supporting columns.

In the above-described construction, the insulating wall and further a top plate constituting a top surface of the machine room can not be fixed, unless the angles are attached to the four corners of the base. Therefore, the number of parts inevitably increases, and operation becomes complicated.

On the other hand, the transparent door is provided on the supporting columns to open and close the display room, and the transparent door is supported so as to be freely revolvable around the supporting column. Therefore, in the operation of opening or closing the transparent door, a strong force is imposed particularly on the column, and hence bending is liable to occur in a vertical direction. As a result, the whole showcase inclines, and when the door is closed, a lower part of the transparent door on the non-supported side thereof hits against a bottom frame for the door, which brings about the so-called "door lowering".

SUMMARY OF THE INVENTION

The present invention has been made to solve the above-described conventional technical problem. An object of the present invention is to provide a showcase wherein an insulating wall and a top plate of a machine room that covers a lower surface of the insulating wall can be stably held and thereby the strength of the whole showcase can be improved.

A first aspect of the present invention is directed to a showcase in which a display room is provided over an insulating wall; a machine room is provided under the insulating wall; a compressor, a condenser and the like of a cooling unit are disposed in the machine room; a cooling room is provided in the insulating wall; and an evaporator and a cooling fan of the cooling unit are disposed in the cooling room so that cold air heat-exchanged with the evaporator is circulated in the display room by the cooling fan; the showcase comprising a top plate of the machine room to cover a lower surface of the insulating wall, the top plate being mounted on and fixed to a pipe plate of the condenser to hold the insulating wall.

A second aspect of the present invention is directed to the showcase according to the first aspect, further comprising a condenser fan that sends air to the condenser, and a fan case which is fixed to the condenser for attaching the condenser fan; wherein the top plate is mounted on the fan case.

A third aspect of the present invention is directed to the showcase according to the first or second aspect, further comprising supporting columns at four corners of the display room, and transparent walls attached to the supporting columns to surround the display room; wherein four corners of the top plate are provided with corner portions each having a predetermined length in a vertical direction, and the supporting columns are attached to the top plate along the corner portions.

A fourth aspect of the present invention is directed to the showcase according to the third aspect, wherein the top plate is formed by bending one steel plate into a substantially rectangular box shape as a whole.

A fifth aspect of the present invention is directed to the showcase according to the fourth aspect, further comprising a cooling fan motor attached to the top plate in the machine room to drive the cooling fan, wherein a portion of a bottom wall of the top plate where the cooling fan motor is positioned is raised by cutting and bending, and in a side wall of the top plate corresponding to the raised portion, a vertical supporting tongue which is inserted under the raised portion to support the raised portion is formed by cutting and bending.

A sixth aspect of the present invention is directed to the showcase according to the third aspect, further comprising a bottom frame to rim an upper periphery of the insulating wall, wherein on the bottom frame, a dew receiver is formed to receive dew condensation water which flows down from an outer surface of a transparent wall, and an upper edge portion of the top plate is brought into contact with and fixed to the dew receiver.

According to a first aspect of the present invention, there is provided a showcase in which a display room is provided over an insulating wall; a machine room is provided under the insulating wall; a compressor, a condenser and the like of a cooling unit are disposed in the machine room; a cooling room is provided in the insulating wall; and an evaporator and a cooling fan of the cooling unit are disposed in the cooling room so that cold air heat-exchanged with the evaporator is circulated in the display room by the cooling fan. The showcase comprises a top plate of the machine room to cover a lower surface of the insulating wall, and the top plate is mounted on and fixed to a pipe plate of the condenser to hold the insulating wall. Therefore, the insulating wall can be stably held on the pipe plate of the condenser that is vertically stably put. As a result, angles become unnecessary that are provided at four corners of the lower surface of the insulating wall for supporting the insulating wall as in a conventional showcase, which can reduce the number of parts and improve productivity.

According to a second aspect of the present invention, in addition to the first aspect, the showcase comprises a condenser fan that sends air to the condenser; and a fan case fixed to the condenser for attaching the condenser fan, and the top plate is mounted the fan case. Therefore, the lower surface of the insulating wall can be held by not only the pipe plate of the condenser but also the upper surface of the fan case fixed to the condenser. This can more stably hold the insulating wall and the top plate covering the lower surface of the insulating wall.

According to a third aspect of the present invention, in the first or second aspect, the showcase comprises supporting columns at four corners of the display room; and transparent walls attached to the supporting columns to surround the display room, and corner portions each having a predetermined vertical length are formed at four corners of the top plate, and the supporting columns are attached to the top plate along the corner portions. Therefore, each supporting column can be brought into contact with the corresponding corner portion of the top plate in a vertically long region corresponding to the shape of the corner portion. As a result, vertically supporting the supporting columns can be realized by the corner portions of the top plate each formed into a vertically long shape. This can avoid a trouble that upper portions of the supporting columns swing leftward or rightward to incline the whole showcase.

In addition, because the top plate to which the supporting columns are attached is fixed to the pipe plate of the condenser, it becomes possible to more stably support the supporting columns.

According to a fourth aspect of the present invention, in the third aspect, the top plate is formed by bending one steel plate into a substantially rectangular box shape as a whole. This can improve the strength of the top plate itself, and makes it possible to stably support the supporting columns by four corner portions.

According to a fifth aspect of the present invention, in the fourth aspect, the showcase comprises a cooling fan motor attached to the top plate in the machine room to drive the cooling fan, and a portion of a bottom wall of the top plate where the cooling fan motor is positioned is raised by cutting and bending, and in a side wall of the top plate corresponding to the raised portion, a vertical supporting tongue which is inserted under the raised portion to support the raised portion is formed by cutting and bending. Therefore, the vertical supporting tongue can stably support the raised portion, to which the cooling fan motor is attached, from the lower side of the raised portion. This can avoid a trouble that the raised portion formed by bending lowers due to the weight of the fan motor and the like.

According to a sixth aspect of the present invention, in the third aspect, the showcase comprises a bottom frame to rim an upper periphery of the insulating wall, a dew receiver is formed on the bottom frame to receive dew condensation water having flowed down from an outer surface of a transparent wall, and an upper edge portion of the top plate is brought into contact with and fixed to the dew receiver. Therefore, waste heats from the compressor and the condenser disposed in the machine room are transmitted to the dew receiver through the top plate. Thus, by using the waste heats in the machine room, the dew condensation water received by the dew receiver can be heated to promote the evaporation.

In addition, because the bottom frame is brought into contact with and fixed to the upper periphery of the top plate, it becomes possible to assemble the top plate and the bottom frame so that the distance between them is constant. This can avoid a trouble that unevenness in height arises in the whole showcase.

DETAILED DESCRIPTION OF THE PREFERRED EMBODIMENT

Figure 1:
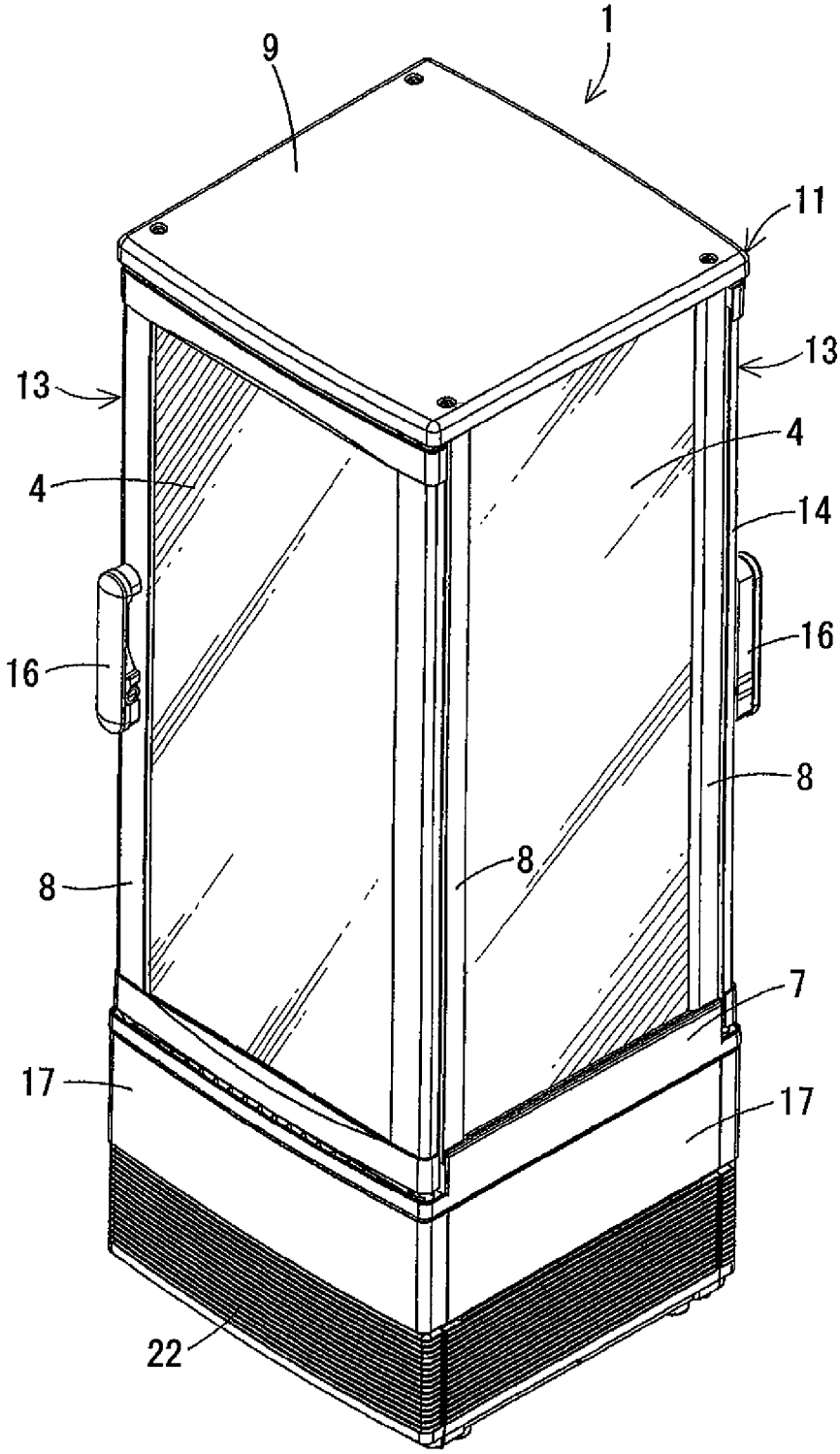
FIG. 1 is a perspective view of a low-temperature showcase according to an embodiment of the present invention.
Figure 2:
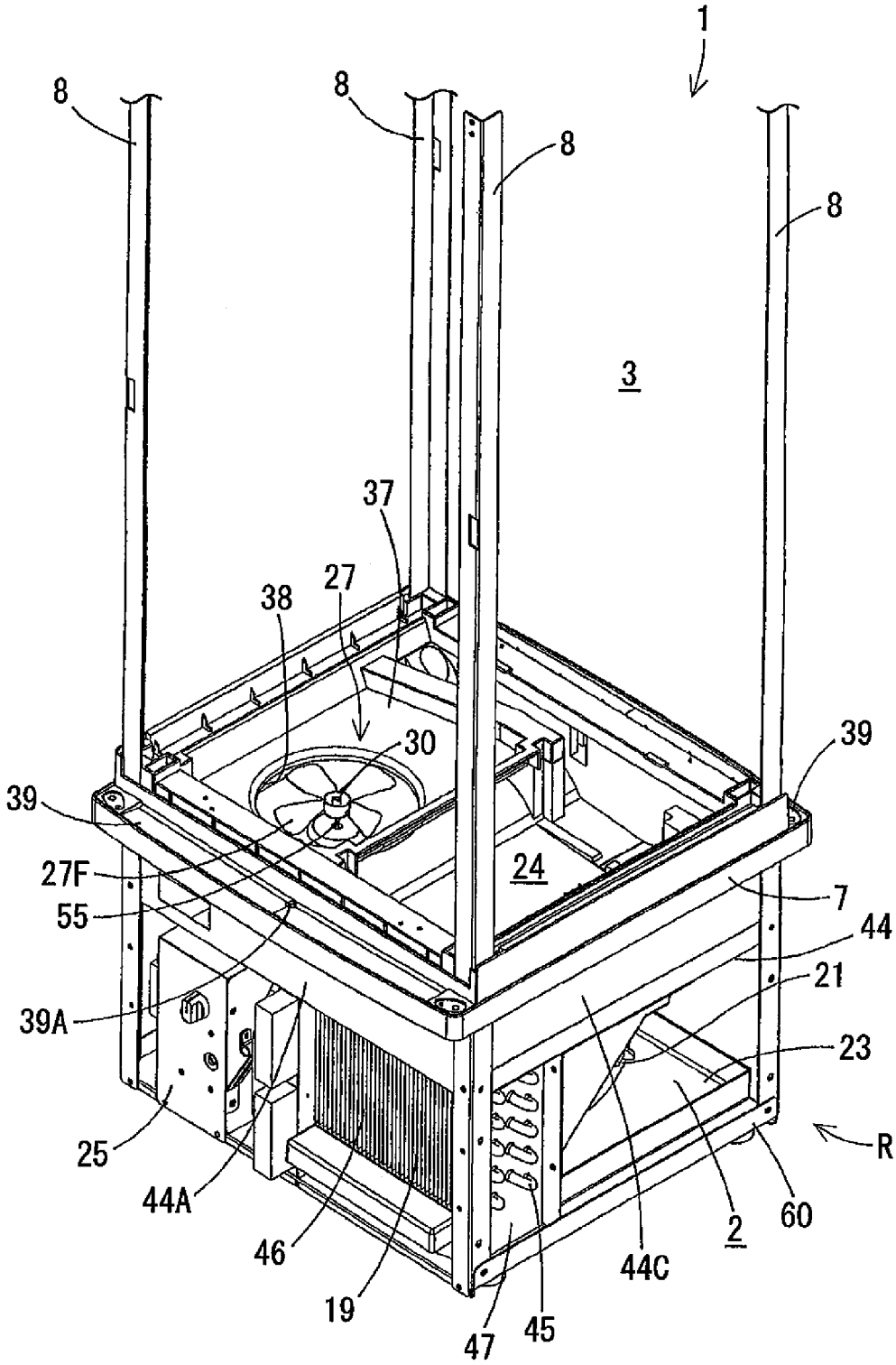
FIG. 2 is a partial enlarged perspective view of the showcase of FIG. 1 in a state that a cooling room and a machine room are exposed.
Figure 3:
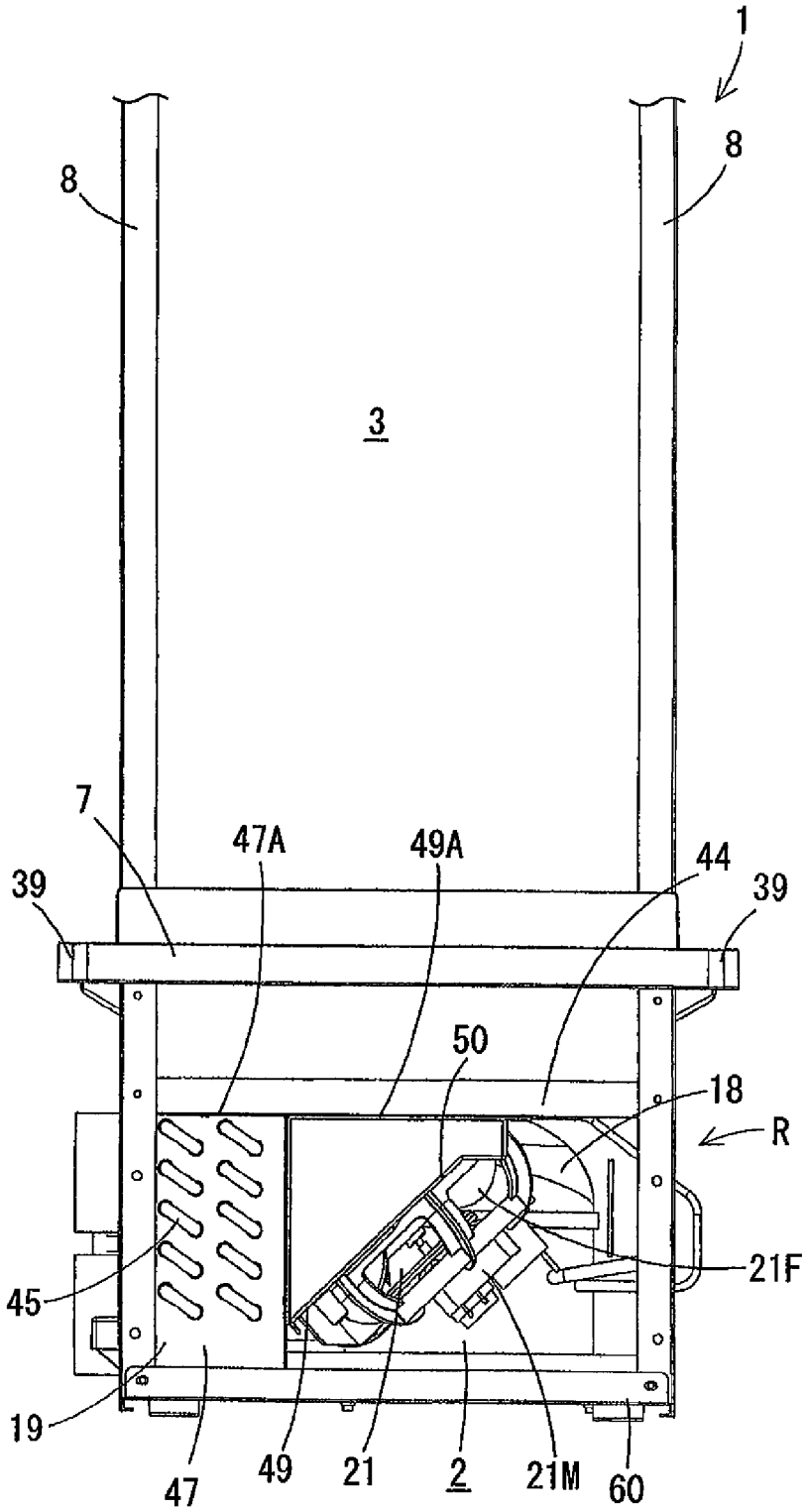
FIG. 3 is a right side view of the showcase of FIG. 2.
Figure 4:
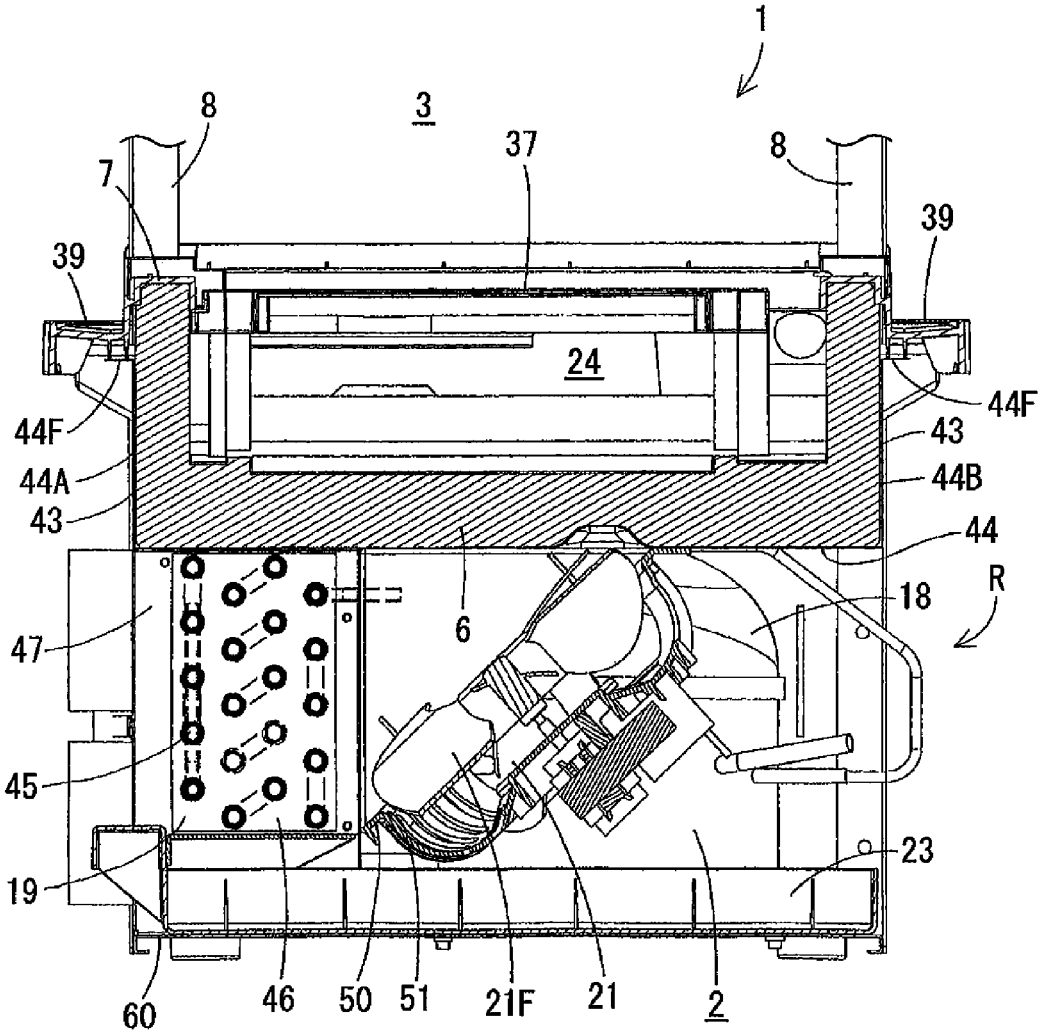
FIG. 4 is a partial enlarged sectional side view of the showcase of FIG. 3.
Figure 5:
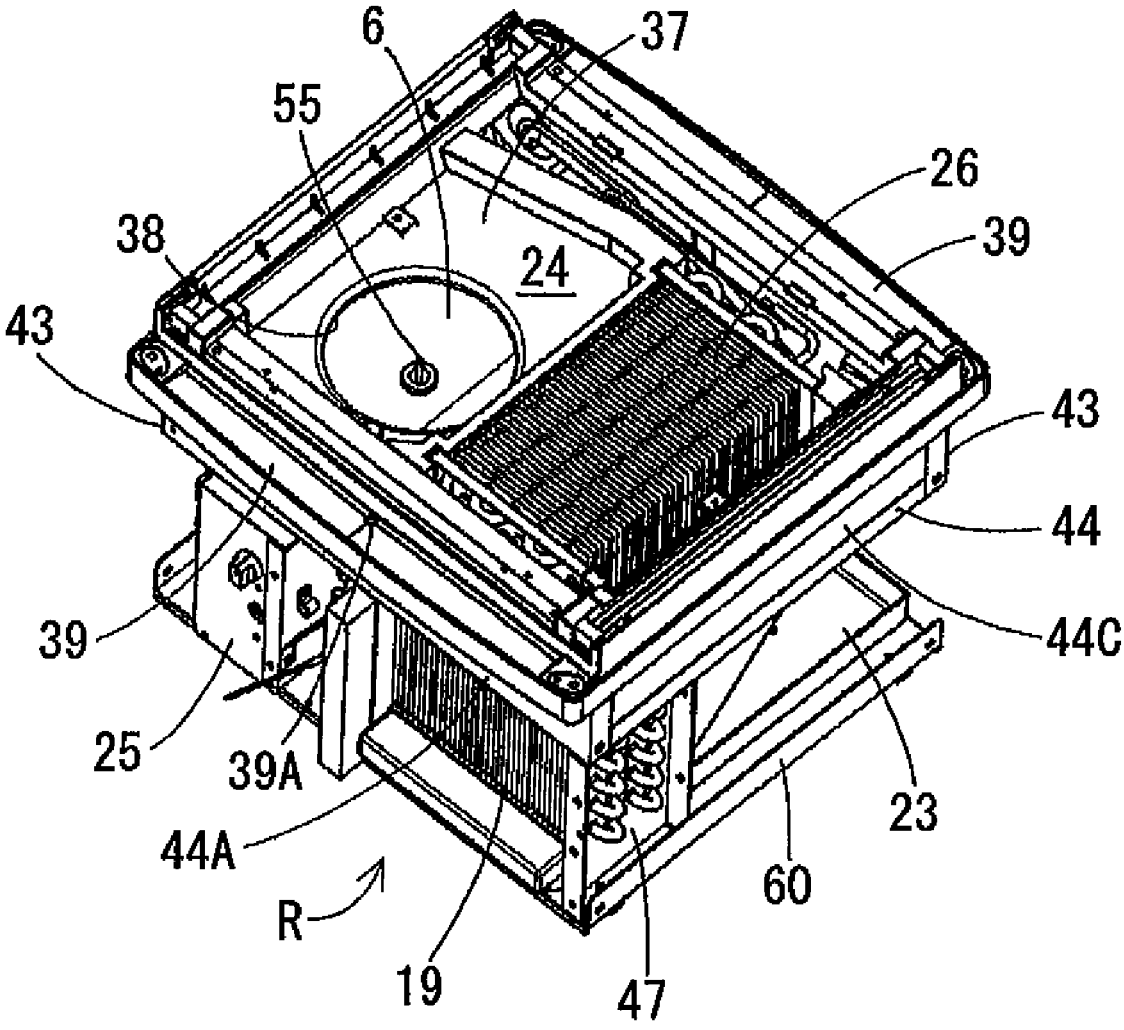
FIG. 5 is a perspective view of a lower part of a main body to which a bottom frame has been attached.

Hereinafter, an embodiment of the present invention will be described in detail with reference to the accompanying drawings. In the drawings, a low-temperature showcase of the embodiment is a four-glass-sided type low-temperature showcase so-called "desk model". A main body 11 of the showcase includes a case-like insulating wall 6 made of foamed polyurethane to be open upward; a bottom frame 7 made of a hard synthetic resin to rim the upper periphery of the insulating wall 6; supporting columns 8 standing at four corners of the bottom frame 7; a top plate 9; left and right transparent walls 4 held by the bottom frame 7, the supporting columns 8, and the top plate 9.

Each of the left and right transparent walls 4 is made of a transparent double-glazed glass. A bottom plate 12 (shown only in FIG. 8) made of a hard synthetic resin is detachably attached onto the insulating wall 6 inside the transparent walls 4. A display room 3 is defined in the main body 11 by the bottom plate 12, the top plate 9, and the left and right transparent walls 4.

The front and rear faces of the display room 3 are open. The front and rear openings of the display room 3 are closed by doors 13 so that each opening can be freely opened. The front and rear doors 13 have the same construction. Each door 13 is attached in the manner that its upper and lower right portions are pivotally supported on the top plate 9 and the bottom frame 7. Each door 13 includes a peripheral sash 14 made of a hard synthetic resin; and a transparent double-glazed glass wall 4 held inside the sash 14. A handle 16 is attached to the front face of each door 14 on the non-supported side, that is, the front face of the left side of the sash 14.

Under the insulating wall 6, a machine room 2 is provided below the display room 3. The periphery of the machine room 2 is covered with detachable panels 17. In the machine room 2 disposed are a compressor 18 and a condenser 19 constituting a refrigerant circuit of a cooling unit R; and in addition, a condenser fan 21 for flowing external air around those to be air-cooled, an evaporating dish 23, and an electric box 25.

The condenser 19 includes meander refrigerant pipes 45, a plurality of radiating fins 46, and pipe plates 47 on both sides. The condenser 19 is disposed in a front portion (at one end) of the machine room 2. The direction of each radiating fin 46 is set so that air flows from the front (the exterior) toward the rear (the interior of the machine room 2). A flange 47A substantially horizontally bent is formed on the upper end of each pipe plate 47 (see FIG. 7). The condenser fan 21 includes a motor 21M and a propeller type fan 21F mounted on a rotating shaft of the motor 21M. The condenser fan 21 is set in a fan case 49 fixed to the rear side of the condenser 19 (inside the machine room 2).

Figure 7:
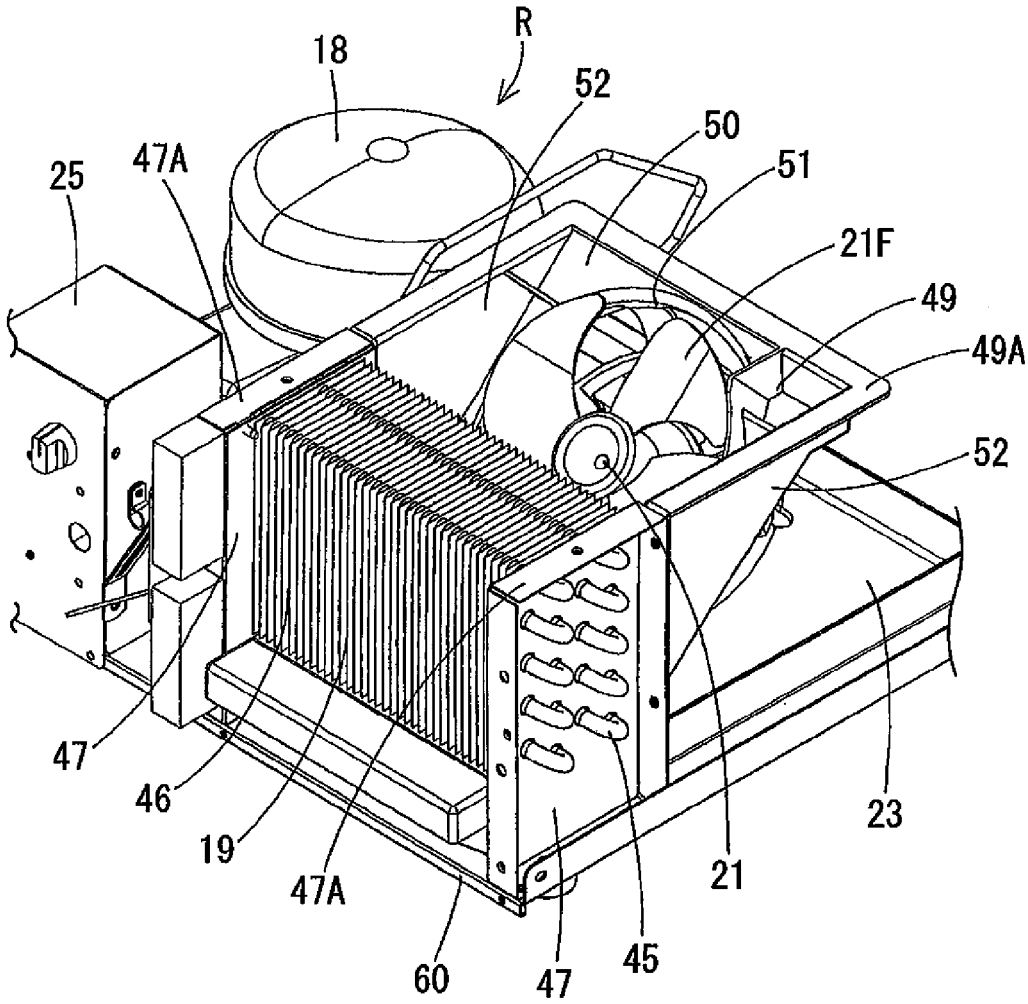
FIG. 7 is a perspective view of the cooling unit in the machine room.

The fan case 49 is made of a hard synthetic resin. As shown in FIG. 7, a grill 51 that the fan 21F faces is formed on an inclined wall 50 inclined at an angle of about 45° so that its side distant from the condenser 19 is high and its condenser 19 side is low when it is attached to the condenser 19. Side walls 52 are formed to extend from the condenser 19 to the inclined wall 50. A flange 49A substantially horizontally bent outward is formed on the upper ends of the side and inclined walls 52 and 50. The upper surface of the flange 49A is on substantially the same plane as the upper surfaces of the flanges 47A formed on the upper ends of the pipe plates 47 of the condenser 19.

When the motor 21M of the condenser fan 21 is driven to revolute the fan 21F, external air is sucked around the condenser 19 from an external air suction port 22 formed in the front panel 17 corresponding to the condenser 19. The condenser 19 is thus cooled by the external air.

In this embodiment, when viewed from the front side, the condenser 19 is at a right position (on one side) in the machine room 2 to correspond to the inside of the front panel 17 of the machine room 2. The condenser fan 21 is positioned on the rear side of the condenser 19. When viewed from the front side, the compressor 18 is positioned on the left back side of the condenser 19 and the condenser fan 21 (at the rear on the other side). When viewed from the front side, the electric box 25 is at a left position (on the other side) in the machine room 2 to correspond to the inside of the front panel 17 of the machine room 2. In at least upper part of the interior of the machine room 2 between the electric box 25 and the compressor 18, a space for installing a motor 27M for a cooling fan 27, as will be described later, is formed by raising the bottom face of the insulating wall 6 and the bottom face of a top plate 44 of the machine room 2 that covers the lower side of the insulating wall 6, though the details will be described later.

A cooling room 24 is provided in the insulating wall 6. The cooling room 24 contains therein an evaporator 26, which constitutes the refrigerant circuit of the cooling unit R with the above-described compressor 18 and the like; and a cooling fan 27. The cooling fan 27 includes a motor 27M and a propeller type fan 27F mounted on a rotating shaft 55 of the motor 27M. A not-shown water discharge outlet formed in the bottom of the cooling room 24 leads to the above-described evaporating dish 23.

In a front view of the low-temperature showcase 1, an anteroposteriorly extending cold air sucking port 28 and an anteroposteriorly extending cold air discharge port 29 are formed at respective right and left positions in the bottom plate 12 at the bottom of the display room 3. The cold air discharge port 29 is connected with the interior of the cooling room 24 on the discharge side of the cooling fan 27. The cold air sucking port 28 is connected with the interior of the cooling room 24 on the cold air flowing-in side of the evaporator 26.

In the bottom frame 7 rimming the upper periphery of the insulating wall 6, a fan case 37 for the cooling fan 27 is provided so as to extend from one side, in this embodiment, the right inner edge of the bottom frame 7 in a front view of the low-temperature showcase 1, and another side forming a corner with the one side, that is, the front inner edge of the bottom frame 7, toward the inside the cooling room 24. The fan case 37 is formed integrally with the bottom frame 7 under the bottom plate 12 attached to the upper periphery of the bottom frame 7. In the fan case 37 formed is a grill 38 that the fan 27F of the cooling fan 27 faces.

On the front and rear sides of the bottom frame 7, outward protruding dew receivers 39 are provided so as to correspond to the lower ends of the doors 13 disposed in the front and rear faces of the display room 3. The dew receivers 39 are for receiving dew condensation water having flowed down from the outer surfaces of the transparent walls constituting the doors 13. At substantially the center of each dew receiver 39, a water discharge hole 39A is formed to introduce the received water into the evaporating dish 23 in the machine room 2.

In four corner portions of the bottom frame 7, not-shown column holes substantially L-shaped in section are formed through which the supporting columns 8 substantially L-shaped in section are inserted.

Figure 6:
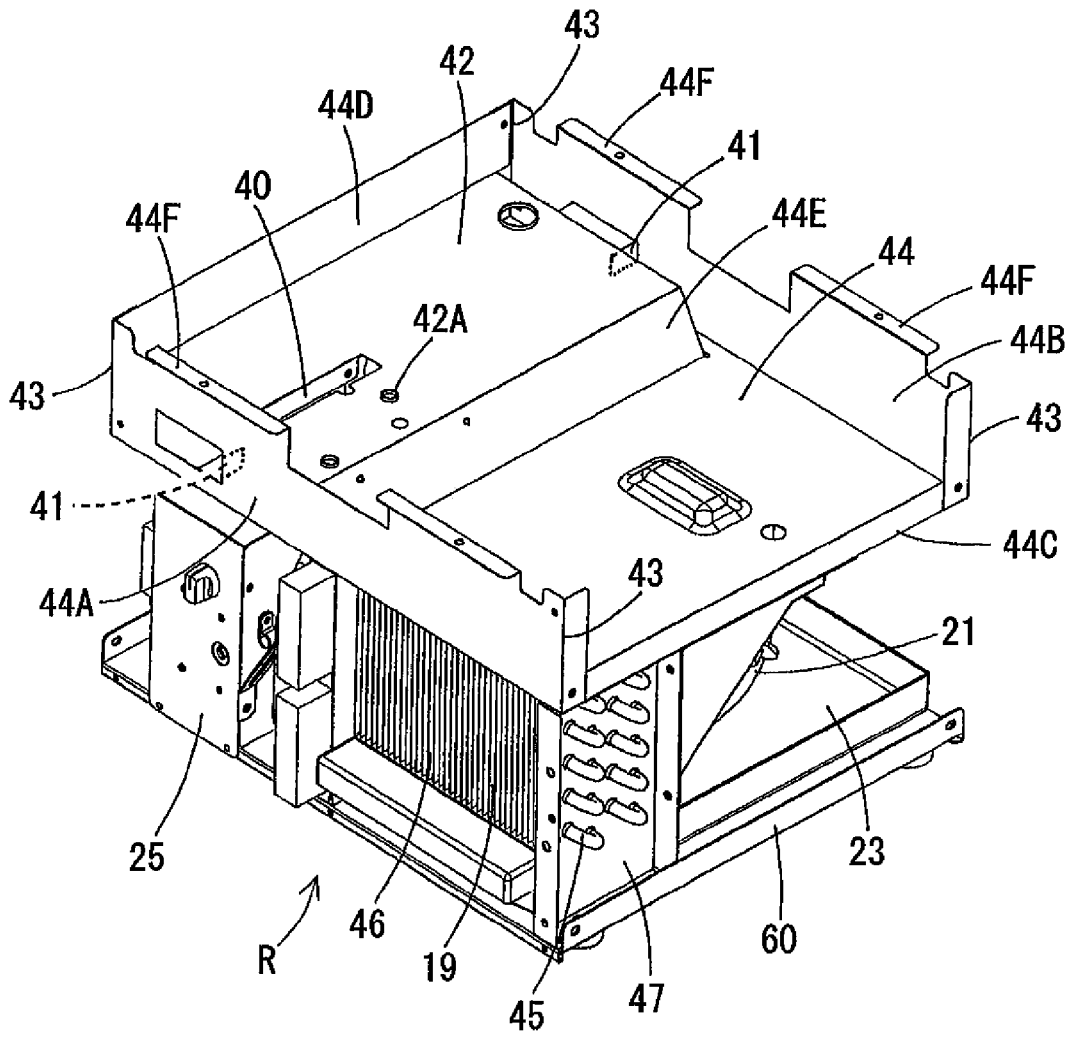
FIG. 6 is a perspective view of a cooling unit in the machine room to which a top plate has been attached.

As shown in FIG. 6, the top plate 44 covering the lower side of the insulating wall 6 has a substantially rectangular section open upward. The top plate 44 is made of a steel-base material so as to cover the lower and side surfaces of the insulating wall 6. In this embodiment, the top plate 44 is formed by bending one steel plate into a substantially rectangular box shape as a whole.

More specifically, front and rear edges of the steel plate are bent upward substantially at a right angle to form a front wall 44A and a rear wall 44B each having a predetermined vertical length. Both side edges of the steel plate are bent upward substantially at a right angle to form side walls 44C and 44D of the top plate 44. In the insulating wall 6, one side portion of its bottom wall, in this embodiment, a left side portion in a front view of the showcase 1, is raised for providing a space in which the motor 27M for the cooling fan 27 is installed.

Therefore, in one side portion of the bottom wall of the top plate 44, in this embodiment, a left side portion in a front view of the showcase 1, an inclined portion 44E is formed that has been bent upward at a predetermined angle by cutting and bending; a raised portion 42 is formed that has been bent so that its upper surface is substantially horizontal outward. The other edge of the top plate 44 is bent upward substantially at a right angle to form the above-described side wall 44C. The bottom wall of the top plate 44 is thus formed so as to be along the shape of the bottom surface of the insulating wall 6.

Both ends of each of the front and rear walls 44A and 44B are bent inward substantially at a right angle to form flanges. The side walls 44C and 44D are fixed to the respectively overlapping flanges with screws. Four corner portions 43 are thus formed in the top plate 44.

Because the top plate 44 is formed by bending one steel plate into a substantially rectangular box shape as a whole, a predetermined strength of the top plate 44 itself ban be ensured. In this case, because the front and rear walls 44A and 44B are formed so as to have a predetermined vertical length, each corner portion 43 has a predetermined vertical length. In this embodiment, the front, rear, and side walls 44A, 44B, 44C, and 44D stand upward to form the corners 43. However, the present invention is not limited to that. Only four corner portions stand upward to form such corner portions 43.

The upper edges of the front and rear walls 44A and 44B are bent outward substantially at a right angle to form upper edge portions 44F. The upper edge portions 44F come into contact with the lower surfaces of the dew receivers 39 of the bottom frame 7 provided around the upper face of the insulating walls 6. In this state, the upper edge portions 44F are fixed to the dew receivers 39 with screws.

In the front and rear walls (side walls) 44A and 44B of the top plate 44 at potions corresponding to the raised portion 42 of the top plate 44, vertical supporting tongues 41 are formed by cutting and bending. The supporting tongues 41 extend under the raised portion 42 to support the raised portion 42.

Therefore, even when the motor 27M for the cooling fan 27 is attached to the lower surface of the raised portion 44 of the top plate 44 as will be described later, the vertical supporting tongues 41 can stably support the raised portion 42 from its lower side. This can avoid a trouble that the raised portion 42 formed by bending lowers due to the weight of the motor 27M and the like.

In a front portion of the raised portion 42, a cooling fan attachment tongue 40 cut and bent downward substantially at a right angle is formed on the upper rear side of the electric box 25 and on the upper front side of the compressor 18. Near the attachment tongue 40, in this embodiment, between the attachment tongue 40 and the inclined portion 44E, a shaft through hole 42A is formed through which the rotating shaft 55 of the cooling fan 27 passes. Also in the bottom wall of the insulating wall 6, a shaft through hole 6A is formed so as to overlap the shaft through hole 42.

The above-described fan 27F of the cooling fan 27 is set in the grill 38 of the fan case 37 provided in the cooling room 24. The motor 27M is attached to a position of the top plate 44 on the machine room 2 side with an attachment plate 56 being interposed.

The attachment plate 56 holds at its lower surface the motor 27M. One edge of the attachment plate 56 is bent downward substantially at a right angle to form an attachment tongue 57. The other edge of the attachment plate 56 is obliquely bent downward at a predetermined angle to form an attachment tongue 58. The attachment tongue 57 can be attached along the inner surface of the attachment tongue 40 formed in the raised portion 42 of the top plate 44. The attachment tongue 58 can be attached along the lower surface of the inclined portion 44E of the top plate 44.

Figure 9:
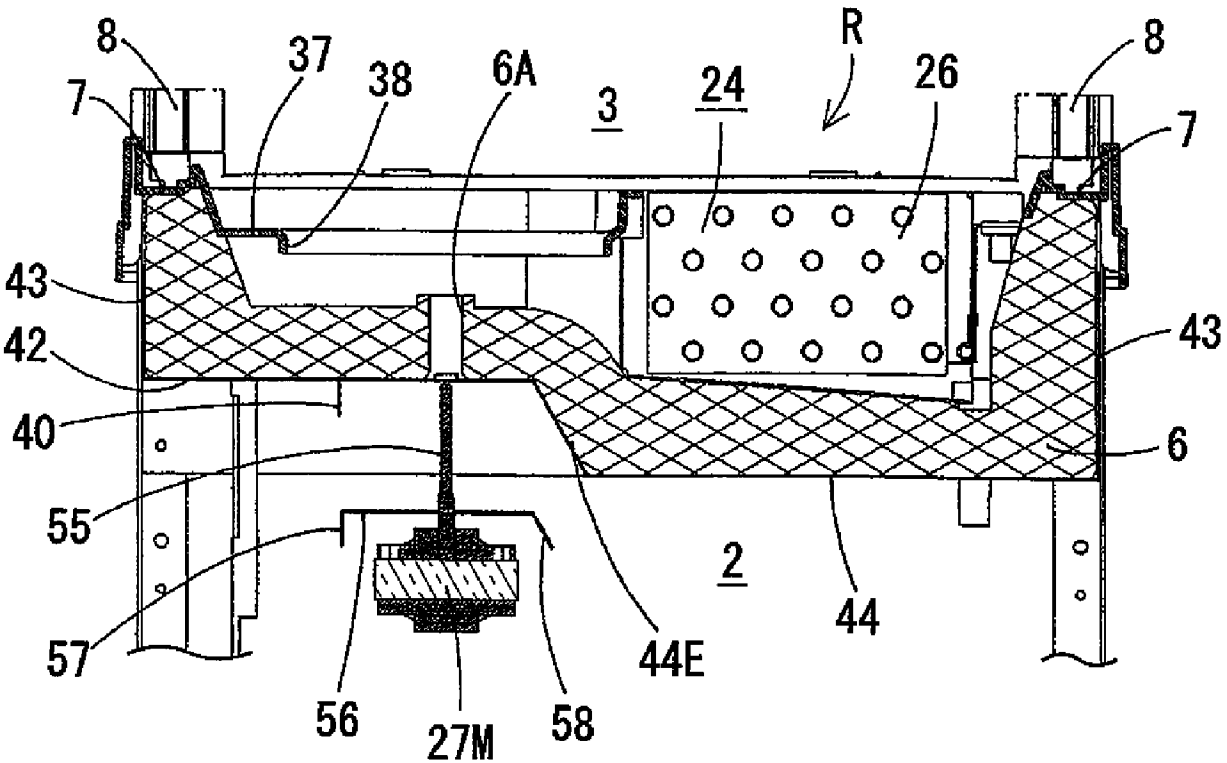
FIG. 9 is an enlarged sectional view of the lower part of the main body to which a cooling fan motor is being attached.

To set the cooling fan 27, as shown in FIG. 9, first, the motor 27M is attached to the attachment plate 56. The rotating shaft 55 extending from the motor 27M is inserted through the shaft through hole 42A formed in the top plate 44 and the shaft through hole 6A formed in the insulating wall 6, so that the upper end of the rotating shaft 55 faces the interior of the cooling room 24 in the insulating wall 6. In this state, the attachment plate 56 to which the motor 27M has been attached comes into contact with the lower surface of the raised portion 42 of the top plate 44. The attachment tongue 57 of the attachment plate 56 overlaps the attachment tongue 40 formed in the top plate 44. The attachment tongue 58 of the attachment plate 56 overlaps the inclined portion 44E of the top plate 44.

On a side of the machine room 2, in this embodiment, on the left side in a front view of the showcase 1, by using screws, the attachment tongue 57 is fixed to the attachment tongue 40 and the attachment tongue 58 is fixed to the inclined portion 44E. Thereby, the fan motor 27M is fixed to the lower surface of the insulating wall 6, that is, the lower surface of the top plate 44 of the machine room 2. The fan 27F is then fixed with a fixture 30 to the upper end of the rotating shaft 55 facing the cooling room 24.

Next will be described a procedure of assembling the showcase 1 having the above-described construction. First, on the upper face of a unit base 60 serving as the bottom wall of the machine room 2, there are disposed the condenser 19, the condenser fan 21, the fan case 49 for the condenser fan 21, the compressor 18, the electric box 25, the evaporating dish 23, and the like. The top plate 44 of the machine room 2 is then mounted on and fixed to the flanges 47A formed at the upper ends of the pipe plates 47 of the condenser 19 and the flange 49A formed at the upper end of the fan case 49 so as to be on substantially the same plane as the flanges 47A. The insulating wall 6 is then attached to the upper face of the top plate 44. In a modification, the top plate 44 that has been attached to the insulating wall 6 may be mounted on and fixed to the upper ends of the condenser 19 and the like.

Because the insulating wall 6 and the top plate 44 are held on the condenser 19 as described above, the insulating wall 6 and the like can stably be held on the pipe plates 47 of the condenser 19 that is vertically stably installed. As a result, no angles are required that are conventionally provided at four corners of the lower face of the insulating wall 6 for holding the insulating wall 6. This can reduce the number of parts and improve the productivity.

In addition, in this embodiment, the insulating wall 6 and the like can be also held by the upper end of the fan case 49 formed so as to be on substantially the same plane as the upper ends of the pipe plates 47 of the condenser 19. The insulating wall 6 and the top plate 44 of the machine room 2 covering the lower face of the insulating wall 6 can more stably be held.

Afterward, the bottom frame 7 is attached to the insulating wall 6 to rim the periphery of the upper face of the insulating wall 6. At this time, because the fan case 37 has been formed integrally with the bottom frame 7 as described above, the fan case 37 is disposed in the cooling room 24 by attaching the bottom frame 7.

The dew receivers 39 formed at the front and rear edges of the bottom frame 7 are then brought into contact with and fixed to the upper edges 44F of the front and rear walls 44A and 44B of the top plate 44.

The evaporator 26 is then disposed in the cooling room 24. The cooling fan 27 is installed as described above in detail. The bottom plate 12 is mounted the bottom frame 7 so as to close the upper face of the cooling room 24.

After the cooling unit R is assembled as described above, the supporting columns 8 are attached to four corner portions of the bottom frame 7, the insulating wall 6, and the machine room 2. The transparent walls 4, the doors 13, and the top plate 9 are then attached to the supporting columns 8 to define therein the display room 11. The supporting columns 8 substantially L-shaped in section are inserted through the column holes formed in the bottom frame 7. The lower ends of the supporting columns 8 are made to pass through the machine room 2 to reach four corner portions of the unit base 60. In this state, the lower ends of the supporting columns 8 are fixed to four corner portions of the unit base 60 with screws.

In this manner, each supporting column 8 substantially L-shaped in section is attached along the shape of the corresponding corner portion 43 of the top plate 44 of the machine room 2. As a result, each supporting column 8 can be brought into contact with the corresponding corner portion 43 of the top plate 44 in a vertically long region corresponding to the shape of the corner portion 43. Thus, vertically supporting the supporting columns 8 can be realized by the corner portions 43 of the top plate 44 each formed into a vertically long shape. This can avoid a trouble that upper portions of the supporting columns 8 swing leftward or rightward to incline the whole showcase 1, and realize stable attachment of the supporting columns 8. Thus, a trouble can be avoided that the whole showcase 1 inclines because of opening and closing operations of the doors 13 for closing the front and rear faces of the display room 3 so as to be freely opened and closed, to bring about the so-called "door lowering", before it happens.

In addition, as described above, the top plate 44 to which the supporting columns 8 are attached is fixed to the pipe plates 47 of the condenser 19. This makes it possible to more stably support the supporting columns 8 and further the whole showcase 1.

Further, in this embodiment, the vertically long supporting columns 8 can be attached after the cooling unit R is assembled. This can facilitate the assembling work and improves the workability.

Further, the bottom frame 7 comes into contact with and fixed with screws to the upper edges 44F of the front and rear walls 44A and 44B of the top plate 44 standing from the lower surface of the insulating wall 6. Therefore, the height from unit base 60 to the upper end of the bottom frame 7 can be constant. This prevents unevenness in the height of the whole showcase 1.

Figure 8:
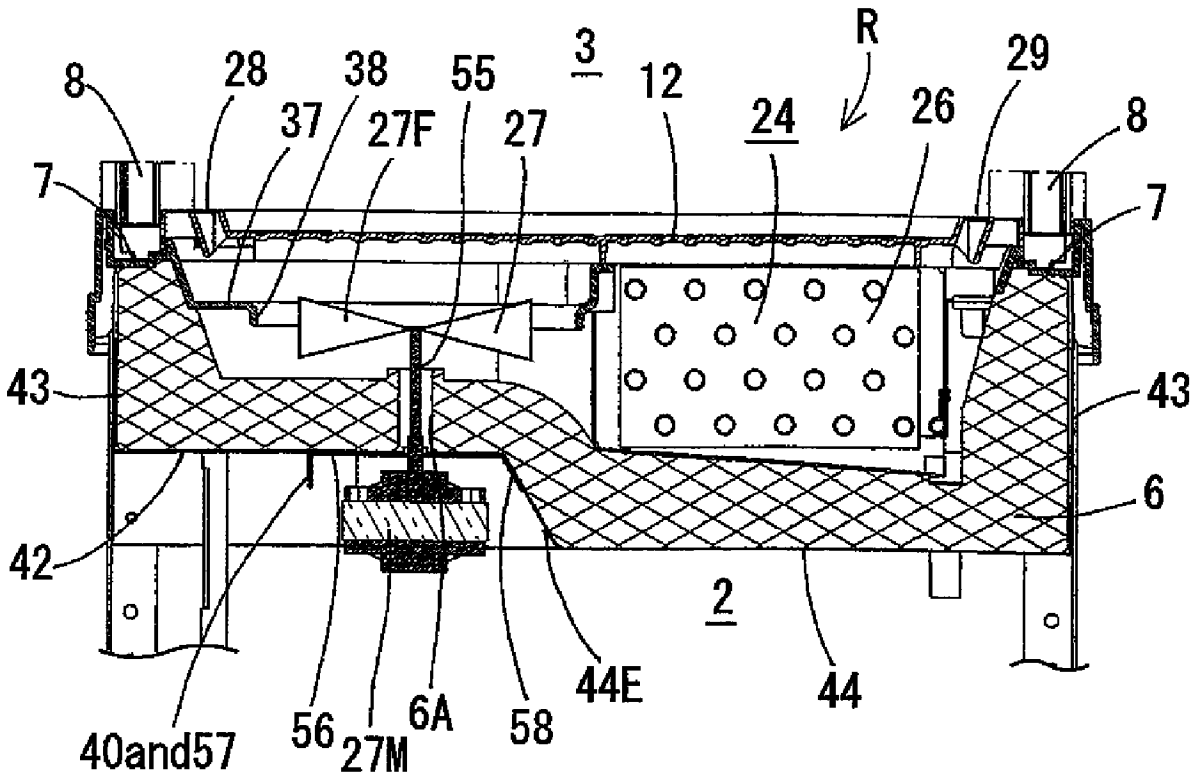
FIG. 8 is an enlarged sectional view of the lower part of the main body.

In the above-described construction, when the compressor 18, the condenser fan 21, and the cooling fan 27 are operated, the evaporator 26 acts for cooling. The condenser 19 and the compressor 18 generate heats to heat the surrounding air. Cold air in the cooling room 24 cooled by heat exchange with the evaporator 26 is sucked by the cooling fan 27 to be ejected through the cold air ejection port 29 into the upper display room 3 (FIG. 8). The cold air ejected into the display room 3 flows upward; circulated in the display room 3 to be cooled to a predetermined temperature; and then flows downward to return through the cold air suction port 28 into the cooling room 24. The air then flows into the evaporator 26 to be cooled. The cooled air is again sucked by the cooling fan 27 to be ejected through the cold air ejection port 29.

Thereby, the interior of the display room 3 is cooled to a predetermined temperature (normally, a refrigeration temperature of +5° C. to +10° C.). At this time, in this embodiment, because the fan case 37 in which the fan 27F of the cooling fan 27 is provided is formed integrally with the bottom frame 7, the fan case 37 can stably be provided in the cooling room 24 formed in the insulating wall 6.

Therefore, it becomes possible to stably control the wind pressure and the wind quantity by the operation of the cooling fan 27 located in the grill 38 of the fan case 37. This can properly perform the circulation of cold air into the display room 3. In addition, because a trouble can be avoided that the fan case 37 jounces by the operation of the cooling fan 27, the fan case 37 can be prevented from generating vibration noise.

Cooling the display room 3 also cools the left and right transparent walls 4 and the transparent walls 4 of the doors 13 surrounding four sides of the display room 3. As a result, the moisture in the external air condenses as dews on the outer surface of each transparent wall 4. The dews flow downward along the outer surface of each transparent wall 4 directly into the corresponding dew receiver 39 provided on the bottom frame 7.

The dew condensation water having flowed into each dew receiver 39 passes through the dew receiver 39 into the cooling room 24, and then it is discharged into the evaporating dish 23 together with defrosted water from the evaporator 26 and the like. To each dew receiver 39 transmitted are waste heats from the compressor 18 and the condenser 19 in the machine room 2 through the top plate 44 of the machine room 2. Therefore, by using the waste heats in the machine room 2, the dew condensation water received by each dew receiver 39 can be heated to promote the evaporation.

On the other hand, there is a case in which the fan motor 27M for the cooling fan 27 must be subjected to maintenance because of a long-term use and so on and occurrence of a failure or the like. For this purpose, the bottom plate 12 is detached; the fixture 30 fixing the fan 27F to the rotating shaft 44 is detached through the upper face of the fan case 37; and then the fan 27F is detached. Afterward, panels 17 surrounding the machine room 2, in particular, the panel 17 facing the attachment tongues 40 and 57 used for attaching the motor 27M for the cooling fan 27, in this embodiment, the left panel 17 in a front view is detached.

A tool is then inserted from a side of the machine room 2 to remove screwing (fixing) with the attachment tongues 40 and 57 fixing the motor 27M to the lower surface of the top plate 44; and screwing (fixing) between the inclined portion 44E and the attachment tongue 58. Thereby, the attachment plate 56 fixing the motor 27M to the top plate 44 is detached from the lower surface of the top plate 44. The motor 27M is then drawn downward together with the attachment plate 56 to draw out the rotating shaft 55 from the shaft through holes 6A and 42A. The motor 27M thus can be taken out of the machine room 2.

After performing exchange and maintenance of the motor 27M, a procedure the reverse of the above is performed in which the motor 27M is attached to the lower surface of the top plate 44 of the machine room 2 and then the fan 27F is attached from the cooling room 24 side.

As described above, the motor 27M can be attached to and detached from the top plate 44 of the machine room 2 from a side of the machine room 2. In a conventional showcase in which the above work is difficult because the machine room 2 has no sufficient height, a hole for attachment is formed in the insulating wall at a position corresponding to the attachment position of the cooling fan motor; and the fan motor is detached from the cooling room side together with an insulating material to stop the hole. In this embodiment, however, such a construction is not required.

This can facilitate the complicated attaching and detaching works for the cooling fan motor 27M, and improve the workability of maintenance. In addition, because it is unnecessary to form a hole in the insulating wall 6 for detaching the fan motor as described above, no particular waterproofing measure is required. Further, the wind pressure and the wind quantity in the operation of the cooling fan 27 can stably be controlled.

Particularly in this embodiment, a portion of the top plate 44 is raised that corresponds to the position of the cooling fan motor 27M. Using the shape of the top plate 44 raised at the raised portion 42, the cooling fan motor 27M is attached on a side of the raised portion 42. Therefore, the cooling fan motor 27M can be fixed using the inclined portion 44E formed by the difference in level of the raised portion 42 from the other portion of the top plate 44. As a result, a fixing work such as screwing can be performed laterally to the inclined portion 44E. This can realize a more improvement of workability and more stable fixing.

What is claimed is:

1. A showcase in which a display room is provided over an insulating wall; a machine room is provided under the insulating wall; at least a compressor and a condenser of a cooling unit are disposed in the machine room; a cooling room is provided in the insulating wall; and an evaporator and a cooling fan of the cooling unit are disposed in the cooling room so that cold air heat-exchanged with the evaporator is circulated in the display room by the cooling fan;

the showcase comprising a top plate of the machine room to cover a lower surface of the insulating wall, the top plate, having a substantially rectangular box shape with a bottom wall and four upstanding walls, being mounted on and fixed to a pipe plate of the condenser to hold the insulating wall;

supporting columns at four corners of the display room, and transparent walls attached to the supporting columns to surround the display room;

wherein four corners of the top plate are provided with corner portions each having a predetermined length in a vertical direction, and the supporting columns are attached to the top plate along the corner portions;

wherein the top plate is formed by bending one steel plate into a substantially rectangular box shape as a whole; and further comprising a cooling fan motor attached to the top plate in the machine room to drive the cooling fan, wherein a portion of a bottom wall of the top plate where the cooling fan motor is positioned is raised by cutting and bending, and in a side wall of the top plate corresponding to the raised portion, a vertical supporting tongue which is inserted under the raised portion to support the raised portion is formed by cutting and bending.

* * * * *